US006546677B1

(12) United States Patent
Featherstone

(10) Patent No.: US 6,546,677 B1
(45) Date of Patent: Apr. 15, 2003

(54) TELESCOPING MAST ASSEMBLY

(75) Inventor: Harry E. Featherstone, Wooster, OH (US)

(73) Assignee: Featherstone Teamed Industries, Inc., Wooster, OH (US)

( * ) Notice: Subject to any disclaimer, the term of this patent is extended or adjusted under 35 U.S.C. 154(b) by 0 days.

(21) Appl. No.: 09/500,509

(22) Filed: Feb. 9, 2000

(51) Int. Cl.[7] ..... E04H 12/34

(52) U.S. Cl. ..... 52/118; 52/121; 52/123.1; 52/125.6; 362/384; 362/385; 362/419

(58) Field of Search ..... 52/115–118, 119, 52/143, 108, 123.1, 121, 125.6; 362/74, 384, 365, 419; 474/206, 209

(56) References Cited

U.S. PATENT DOCUMENTS

| | | | | |
|---|---|---|---|---|
| 143,182 A | | 9/1873 | Pierson | |
| 301,019 A | | 6/1884 | Teal | |
| 456,382 A | | 7/1891 | McPartland | |
| 713,911 A | | 11/1902 | McPartland | |
| 722,552 A | | 3/1903 | Anderson | |
| 1,035,570 A | | 8/1912 | Marshall | |
| 1,183,960 A | | 5/1916 | Bienenstock | |
| 1,261,112 A | | 4/1918 | Bielhen | |
| 1,271,391 A | | 7/1918 | Trojan | |
| 2,616,768 A | | 11/1952 | Stemm | |
| 3,296,757 A | | 1/1967 | Goodman | |
| 4,337,560 A | | 7/1982 | Slysh | |
| 4,413,451 A | | 11/1983 | Featherstone et al. | |
| 4,488,209 A | | 12/1984 | Gosswiller | |
| 4,566,714 A | | 1/1986 | De Witt et al. | |
| 4,594,824 A | | 6/1986 | Ziegler et al. | |
| 4,600,980 A | | 7/1986 | Dahlgren | |
| 4,772,869 A | | 9/1988 | Grammas et al. | |
| 5,066,866 A | | 11/1991 | Hallidy | |
| 5,102,375 A | | 4/1992 | Featherstone | |
| 5,107,672 A | | 4/1992 | Featherstone | |
| 5,139,464 A | | 8/1992 | Lehnert | |
| 5,168,679 A | | 12/1992 | Featherstone et al. | |
| 5,203,746 A | | 4/1993 | Lehnert | |
| 5,218,375 A | * | 6/1993 | Hillman | 343/883 |
| 5,572,837 A | | 11/1996 | Featherstone et al. | |
| 5,718,087 A | * | 2/1998 | Featherstone et al. | 52/121 |
| 5,743,635 A | * | 4/1998 | Hulse et al. | 362/385 |
| 5,980,070 A | * | 11/1999 | Hulse et al. | 362/385 |

OTHER PUBLICATIONS

Ball Drive Actuator—85151/85152 Motion Systems Corporation—Technical Data.
Ball Drive Actuator—85257/85258 Motion Systems Corporation—Technical Data.

* cited by examiner

*Primary Examiner*—Carl D. Friedman
*Assistant Examiner*—Yvonne M. Horton
(74) *Attorney, Agent, or Firm*—Richard B. O'Planick

(57) ABSTRACT

A telescoping mast assembly having a ball drive actuator drive system. A telescoping mast section is housed within a base mast section mounted to a base plate. The base mast section pivots about a pivot axis between a lowered, horizontal position and an upright, vertical position and includes an upper elongate body disposed an upper side of the pivot axis and a bottom end disposed on an opposite side of the pivot axis. A ball actuator drive includes an electrically powered motor that drives a ball screw reciprocally inward and outward along a linear stroke path. A remote end of the ball screw is attached to the bottom end of the base mast section and, by pushing and pulling the bottom end of the base mast section, pivots and maintains the base mast section to alternative positions between the fully raised and the fully lowered positions. A telescoping mast section is housed within the base mast section and telescopes between an extended position and a retracted position. A secondary ball screw actuator is housed within the base mast section and is coupled to drive the telescoping mast section between its extended and retracted positions.

22 Claims, 7 Drawing Sheets

TELESCOPING MAST ASSEMBLY

BACKGROUND OF THE INVENTION

1. Field of the Invention

The present invention relates generally to a telescoping mast assembly useful in sundry applications and, more specifically, to a telescoping mast assembly suitable for mobile field use.

2. The Prior Art

Telescoping masts are well known safety devices useful in law enforcement, industrial, military or commercial applications. Such masts are portable devices which can be readily deployed when needed and readily returned to a storage position when not in use. Typical applications are those in which equipment or devices require elevation in order to optimally accomplish their intended function. It may be desirable, or essential, to elevate floodlights, cameras, antennas, or other surveillance equipment by means of a telescopic mast assembly in order for such devices to function optimally. By way of example, one common application is to mount a telescopic light mast upon the roof of a vehicle for illuminating a wide area surrounding the vehicle. The mast must quickly and reliably deploy when necessary, and retract against the roof of the vehicle when not in use. Law enforcement officials, in particular, have found such devices useful in the field.

Heretofore, telescoping masts have been either pneumatically, hydraulically, or chain driven. Pneumatic drive motors require airtight seals between telescopic mast sections in order to function as intended. However, the environment in which such masts are used makes maintaining an airtight condition between mast sections problematic. Contaminants, or radial ice, deposited between mast sections, or at the junction will stop the mast from descending or cause damage to the mast sections, and can easily destroy the seal required for efficient operation of the pneumatic drive. In the event that the pneumatic integrity of the seal is destroyed, the mast will fall gravity with a potential for disastrous consequences.

A further disadvantage to pneumatically powered telescoping masts is that they can only assume one of two positions. Either the masts are fully extended or fully retracted. In many applications, however, because of obstructions or other considerations, it is desirable to have the telescoping mast sections in a partial state of extension or retraction. A further disadvantage with pneumatic drives is that they are relatively heavy in weight, limiting their suitability for vehicle roof applications. In addition, such drives are expensive to manufacture, assemble, and maintain, which limits their commercial appeal.

Finally, in applications where the unit is used on uneven terrain, pneumatic units cannot work consistently on grades exceeding fifteen degrees and, if the loading at the top is high, even less. The tubes on pneumatic masts on slopes exceeding the limit may bend at the joint, causing air leakage at the junction and a corresponding failure. A unit accordingly is needed which can safely maintain structural integrity on slopes exceeding fifteen degrees.

Hydraulic systems for elevating masts suffer from many of the same shortcomings. Hydraulic drives are relatively heavy in weight and are expensive to manufacture, assemble, and maintain. Moreover, such drives are vulnerable to damage from contact with the environment since hydraulic lines are exposed. Additionally, contaminants can infiltrate the hydraulic system and cause malfunction or failure.

Chain driven telescopic masts likewise suffer from the same deficiencies. The drive mechanisms are relatively heavy in weight and are expensive to manufacture, assemble, and maintain. The chain link mechanism is also exposed and susceptible to damage from contact with environmental objects.

Other shortcomings common to the aforementioned conventional telescopic mast drives and devices are that the wiring to the outboard end of the mast is exposed and can be damaged by inadvertent contact with surrounding obstacles or suffer from damage from exposure to the elements. Moreover, the masts are generally fabricated from conductive material from the base to the top end. An electrical charge introduced into such, masts from inadvertent contact with exposed overhead electrical lines will, accordingly, be transferred to the vehicle below, causing a potential for danger to the operators on the ground. Available systems lack effective means for preventing such a charge transfer, such as a fuse system. However, even were fuses implemented into wiring of available units, because the wiring is exposed to the elements, such fuses would be prone to damage and deterioration from exposure to the elements and may not function as intended when they are needed.

SUMMARY OF THE INVENTION

The present invention overcomes the aforementioned deficiencies in available telescoping mast systems by providing a ball actuator drive system. A telescoping extendible mast section is housed within a base mast section which mounts to a base plate. A first ball actuator mounts to the base plate and drives the base mast section between a horizontal storage position and a vertical work position. The base plate ball actuator comprises an electrically powered motor which drives a ball screw along a stroke path. A remote end of the ball screw is attached to a bottom end of the base mast section and pivots the base mast into alternative angles of elevation by pushing and pulling against the bottom end of the base mast section. The base mast section can, accordingly, be placed and held in any angle required between the storage and work positions.

The telescoping extendible mast section is likewise driven between an extended position and a retracted position by a second ball actuator drive system. The second drive system is fixedly mounted within the base mast section and comprises a drive screw affixed at a remote end to the extendible mast section. Movement of the drive screw along a stroke path pushes and pulls the extendible mast section into alternative positions between the extended and retracted positions. The extendible mast section can, as with the base mast section, be placed and maintained in any of the alternative positions to conform to the physical constraints of the space in which the mast is used. The extension of the extendible mast section is independent of the elevational operation of the base mast section, affording the user a wide range of options for optimally positioning the telescoping mast. Positive actuation of the mast sections in both directions by the drive motors will operate effectively on slopes of twenty degrees or more.

Additional stages of telescoping mast sections may be employed in order to increase the maximum reach of the mast. A ball drive actuator for each such additional section can be likewise utilized. The mast sections and ball drive actuators are relatively light weight and are readily assembled and maintained. In addition, the wiring which supplies power and control signals to the ball drive actuators and to electrical devices mounted to a remote end of the mast assembly is housed entirely within the axial passageway of the coaxial mast sections. Protected from exposure to the elements, or damage from contact with surrounding objects, degradation or damage to the wiring is avoided.

The top section of the mast is composed of non-electrically conductive material in a preferred embodiment. Such a composition prevents that section from transferring an electrical charge to the vehicle to which the mast assembly is mounted. Danger to operators below from inadvertent contact between the remote section of the mast and exposed overhead conductors is, thereby, avoided. Further, inasmuch as the wiring to the top of the mast is protected within the mast sections from the elements and from damaging contact with environmental obstructions, an effective and reliable fuse system can be incorporated into the wiring harness which will stop the transfer of electrical current from the wires into the base of the unit and therefrom into the vehicle frame.

Accordingly, it is an objective of the present invention to provide a telescoping mast assembly having an improved drive system for motivating a plurality of mast sections between storage and work positions, and into alternative positions therebetween.

A further objective of the invention is to provide a telescoping mast system having means for encasing and protecting wiring which is routed from the base to the remote end of the mast.

Yet a further objective is to provide a telescoping mast system having a positive drive mechanism associated with each mast section, which independently pushes and pulls its respective mast section between an up and a down position, and into alternative positions therebetween.

Another objective is to provide a telescoping mast system having improved means for electrically isolating the underlying vehicle on which the mast system is mounted.

Still a further objective is to provide a telescoping mast system which is relatively lightweight and protected from deterioration due to exposure to the elements.

A further objective is to provide a telescoping mast system comprised of relatively inexpensive components which are economically and readily assembled and easily maintained.

These and other objectives, which will be apparent to those skilled in the arts, are achieved by a preferred embodiment which is described in detail below and which is illustrated by the accompanying drawings.

DESCRIPTION OF THE PREFERRED EMBODIMENT

Figure 1:
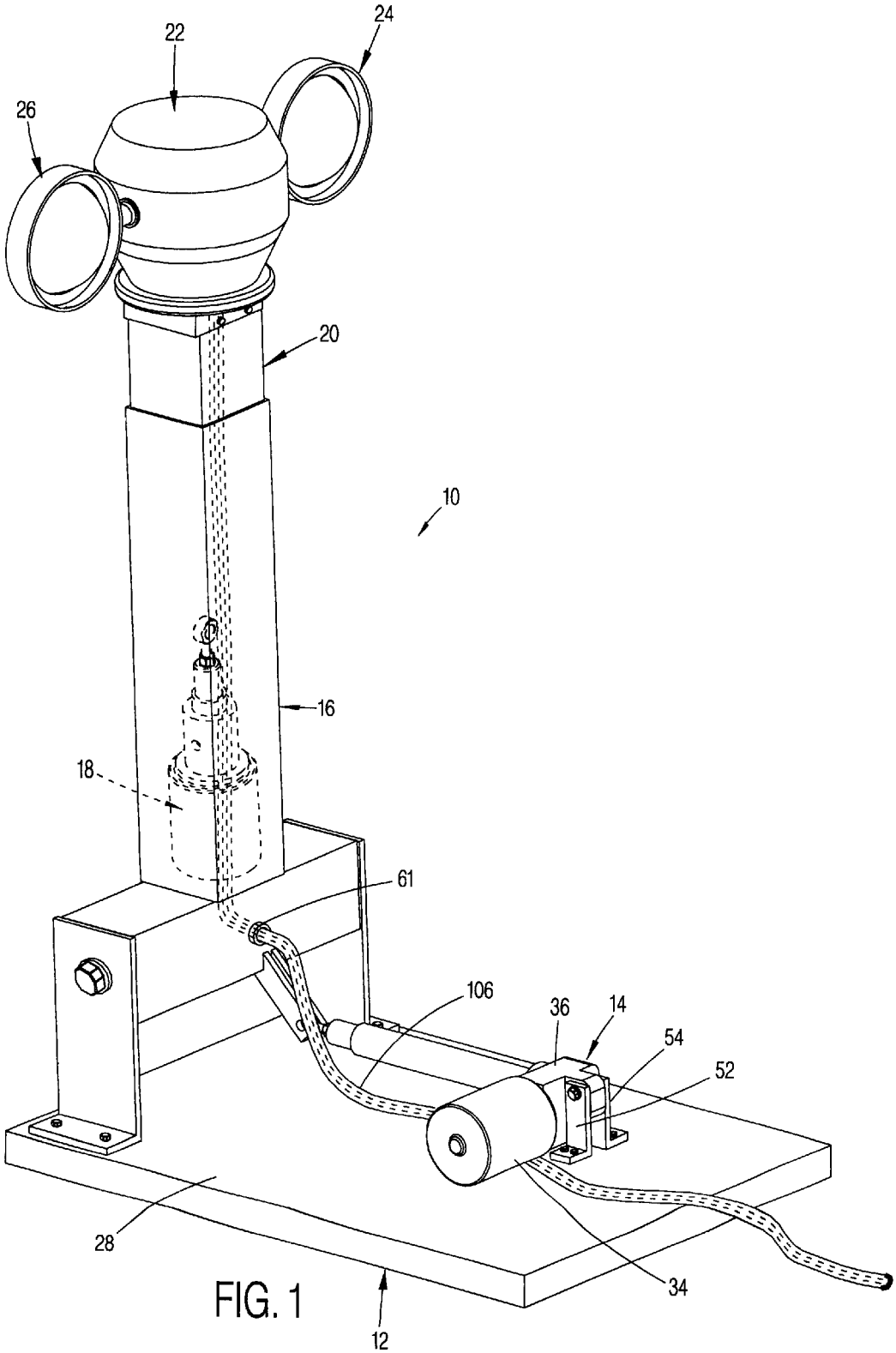
FIG. 1 is a right front perspective view of the subject telescoping mast system shown in the raised position.
Figure 2:
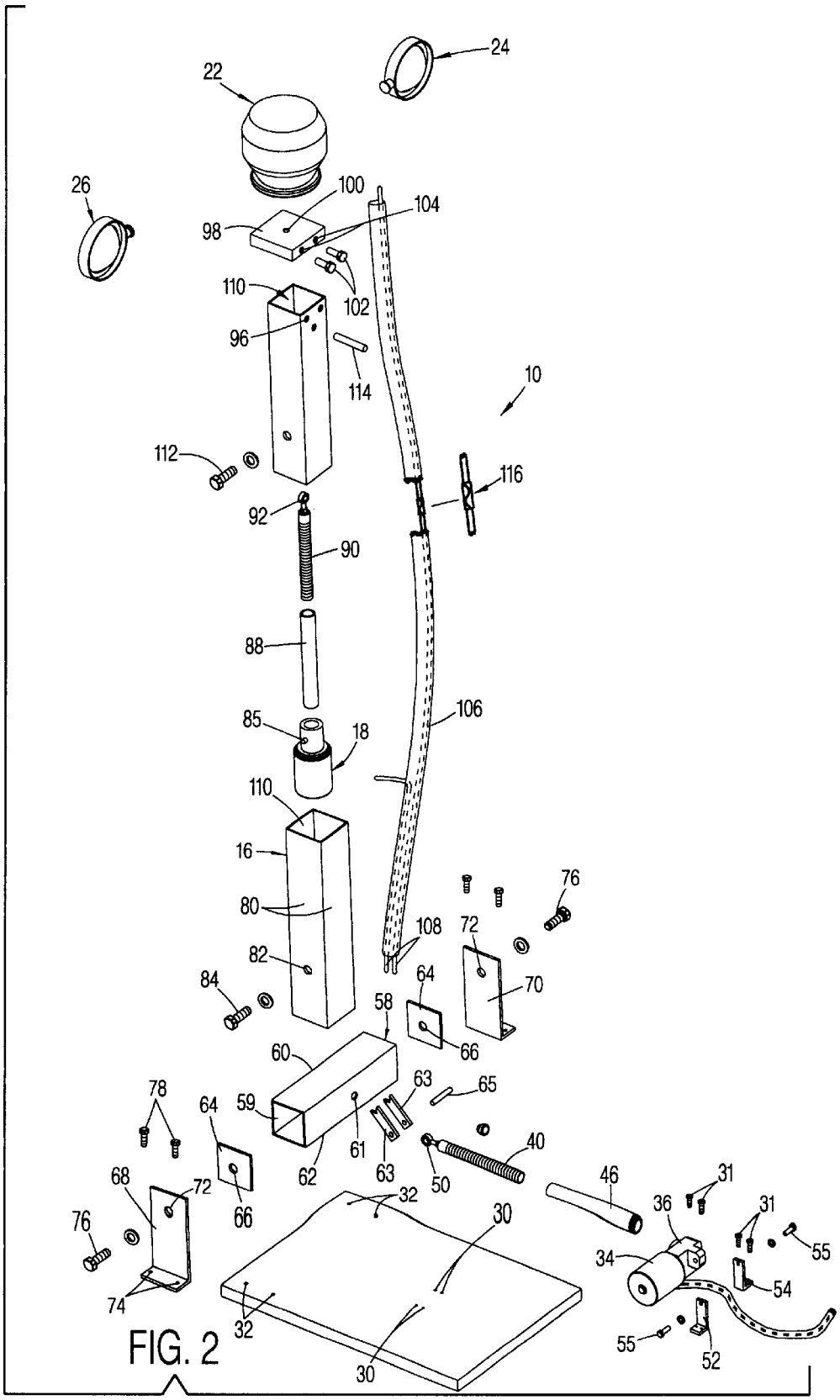
FIG. 2 is an exploded perspective view thereof.

Referring first to FIGS. 1 and 2, the subject telescoping mast assembly 10 is shown comprising, generally, a base mounting plate 12; a first drive motor 14; a base mast section 16; a second drive motor 18; an extendible mast section 20; a motorized light assembly 22; and two lamps 24, 26. The base plate is fabricated from steel or other suitably strong material and includes an upper surface 28, four rearward mounting apertures 30, and four forward mounting apertures 32. The base plate 12 is intended to further include means (not shown) for attachment to a vehicle surface, most commonly a roof. Means for attachment is conventionally by welding.

Figure 5:
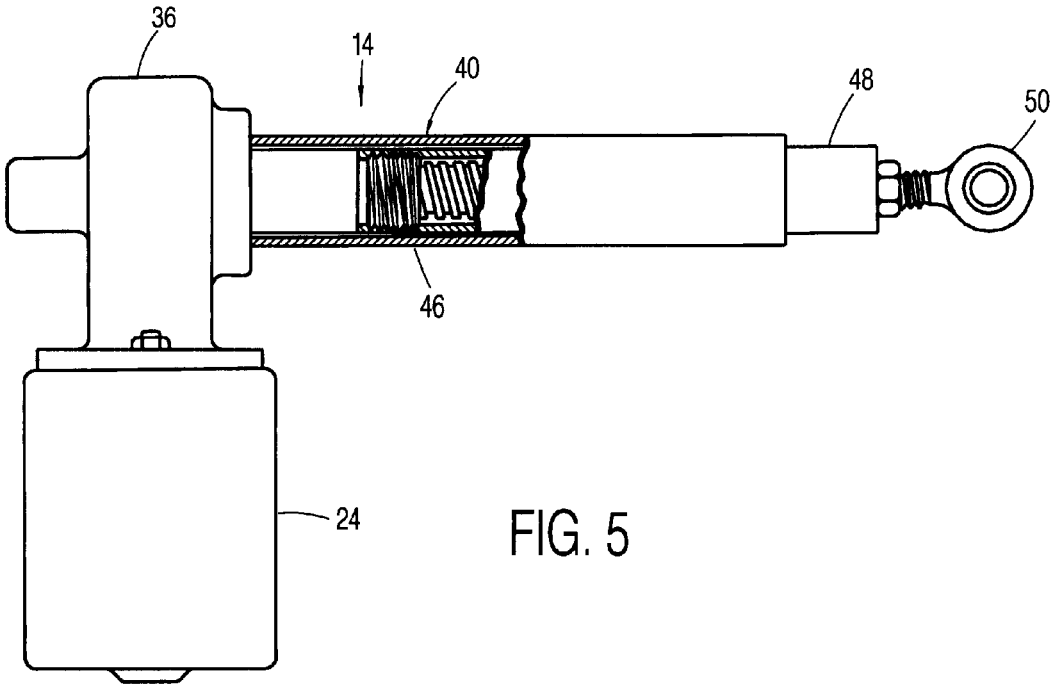
FIG. 5 is a side elevational view, partially in section, of the ball drive actuator for the base mast section.
Figure 6:
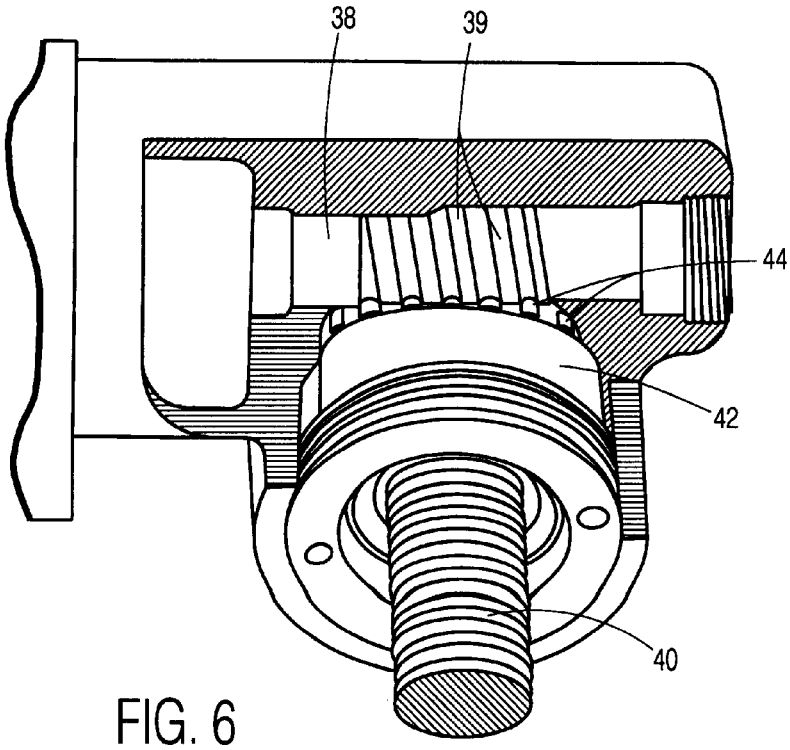
FIG. 6 is an enlarged perspective view of ball drive portion of the ball drive actuator for the base mast section.

Continuing, with reference to FIGS. 5 and 6, the first drive motor 14 is preferably a ball actuator of a type available in the industry. By way of example, without intending to limit the scope of the invention, a suitable ball actuator is manufactured and sold by Motion Systems Corporation located at 600 Industrial Way West, Eatontown, N.J. 07724 under part number 85152. The ball actuator comprises a motor housing 24 and a gear box housing 36, a worm shaft 38 having threads 39, and a ball drive screw 40. The screw 40 includes a geared epicyclic ball 42 at an inboard end across which gear teeth 44 are spaced. A tubular cover 46 encases the ball drive screw 40 forward to a ball screw forward end 48. Extending forward from the end 48 is an attachment eyelet 50.

Figure 3:
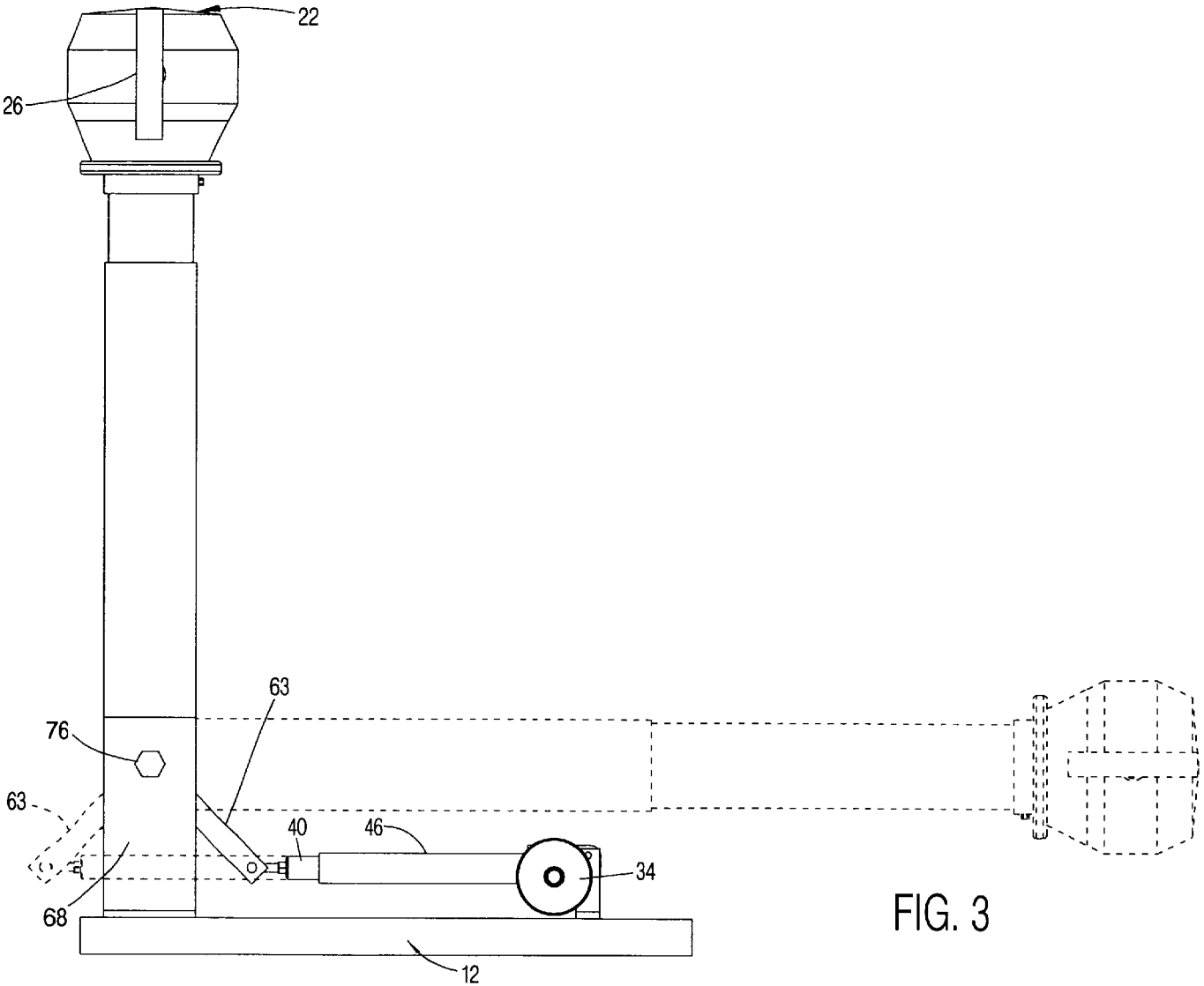
FIG. 3 is a side elevational view thereof.
Figure 4:
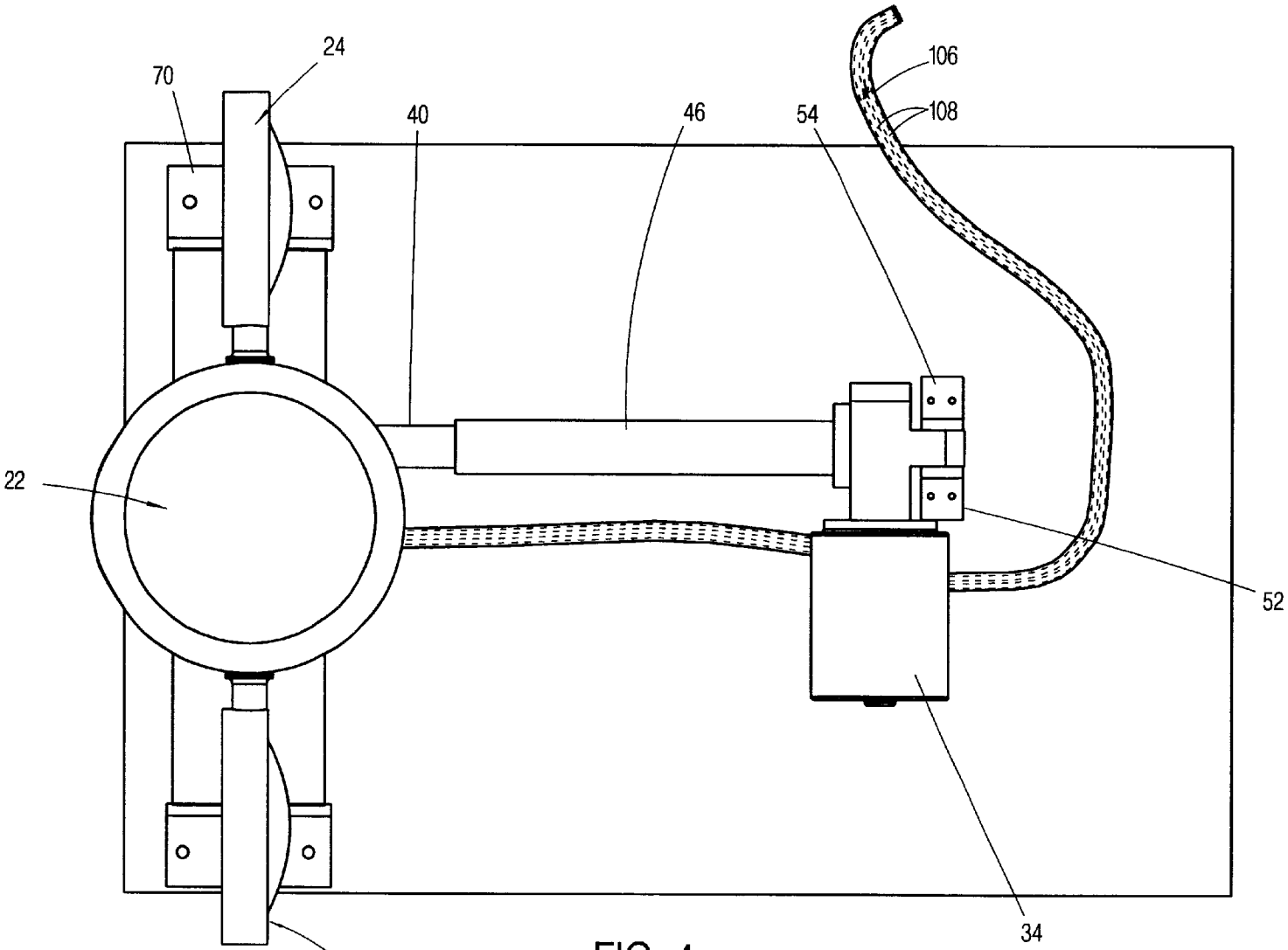
FIG. 4 is a top plan view thereof.

The stroke of the screw 40 is selected to correspond with the pivoting of the base mast section between a horizontal, "down", position and a vertical "up" position as shown in FIG. 3. The loading of the Model 85152 motor of the preferred embodiment is recommended at five hundred pounds or less. The basic construction of the ball actuator 14 incorporates a high efficiency 0.653 inch diameter epicyclic ball screw 40 with integral freewheeling at stroke ends to eliminate the need for limit switches.

The actuator 14 transmits thrust with the epicyclic ball screw 40. Stop pins are provided (not shown) at each end of travel to initiate freewheel and linear advancement stops at those points. The epicyclic ball screw 40 thus moves along a reciprocal linear path to push and pull against the base mast section as will be explained below.

Motor speed reduction to drive the ball drive 40 is by means of a single stage worm gear reducer. The worm shaft 38 runs in a bearing at the motor end and a ball bearing at the opposite end and drives the ball screw 40. Both the worm and gear are fabricated from heat treated steel and are sealed and permanently lubricated. The reduction ratio utilized is preferably 10:1 but other ratios can be utilized to vary the stroke speed.

The motor 24 is electrically powered in the preferred embodiment. For vehicle usage, the motor 24 can be 12VDC; however, for other applications an AC configuration is available. The stroke length of the ball screw 40 is preferably eight and one-half inches; however other stroke lengths may be designed into the telescoping mast assembly within the teachings of the invention.

The cover 46 is fabricated from aluminum with a ring seal at its outboard end in order to protect the screw 40. The ball screw end 50 is self-aligning and a weatherproof motor enclosure is provided to protect the motor from the elements.

With reference to FIGS. 1 and 2, the gear box 36 is mounted to the base plate 12 top surface 28 by means of L-shaped brackets 52, 54 which attach through apertures 30 of the plate 12 by means of screws 31, and into the motor housing 36 by screws 55. A base mast support arm 58 is provided, formed of steel stock and having a square cross sectional axial passageway 59 therethrough. The support arm 58 comprises an upper surface 60, a centrally disposed aperture 61 extending through a rearward facing side, and a lower rearward facing edge 62. A pair of spaced apart steel pivot arms 63 are affixed to the lower edge 62 of support arm 58, by a welded joint or other suitable means, and depend downward therefrom at a substantially 45 degree angle. A pair of end covers 64 are also provided for attachment to the opposite ends of arm 58 and each cover 64 is provided with a centrally disposed through aperture 66. A connector pin 65 is further provided to affix the end 50 of ball screw 40 to the arms 63 as shown.

A pair of mounting L-shaped brackets 68, 70 are included in the assembly, each having a central aperture 72 in an upstanding portion and a pair of apertures 74 in a horizontal portion. The brackets 68, 70 are preferably fabricated of stainless steel stock and affix to outward sides of the covers 64. Aperture 72 of the brackets 68, 70 align with a respective aperture 66 of: the covers 68,70 and pivot pins 76 are provided to project through the coaligned apertures, whereby pivotally joining the support arm 58 to brackets 68,70. Screws 78 project through the apertures 74 and into apertures 32 of the base plate 12 to secure the brackets 68,70 to the base plate. The arms 63 are affixed, preferably by welding, to the lower front edge 62 of the support arm 58 and provide the means through which member 58, pivotally suspended between brackets 68, 70 above support plate 12, is pivotally actuated according to the teachings of the invention.

The base mast section 16 is a square, four sided elongate arm, having four sides 40, a pair of through apertures 82 (one of which shown in FIG. 2), and a central, axial through passage 110. The base mast passage 110 is intended to receive and support therein the second drive motor 18 shown in FIG. 2 and in greater detail in FIG. 7.

Figure 7:
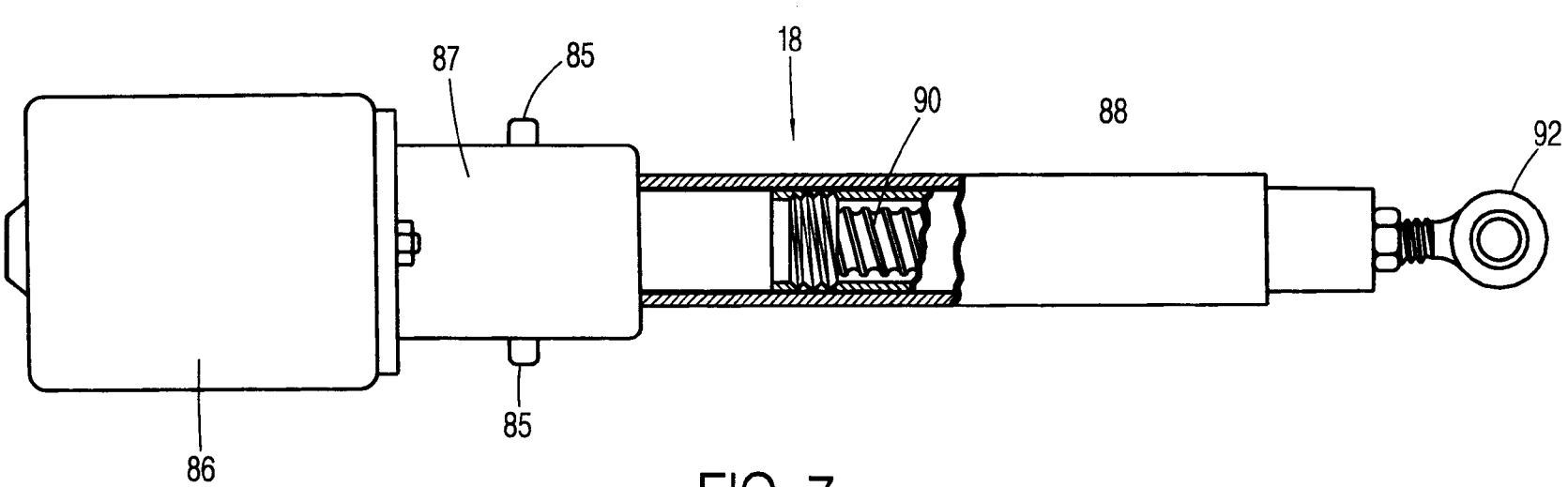
FIG. 7 is a side elevational view, shown partially in section, of the ball drive actuator for the extendible mast section.

Referring to FIG. 7, the second drive motor 18 is an in line ball drive actuator, of a type available in the industry. By way of example, without intending to limit the scope of the invention, a suitable ball actuator is manufactured and sold by Motion Systems Corporation located at 600 Industrial Way West, Eatontown, N.J. 07724 under part number 85258. The ball actuator comprises a motor housing 86 and a gear box housing 87, a pair of outwardly extending lugs 85, and a ball drive screw 90. The screw 90 includes a geared epicyclic ball (not shown) at an inboard end across which gear teeth are spaced. A tubular cover 88 encases the ball drive screw 90 forward to a forward rod end eyelet 92.

The stroke of the screw 90 is selected to correspond with the requisite distance between full "in" and full "out" positions of mast section 20, as will be appreciated from FIGS. 1 and 3. The stroke length in the subject application is selected as thirty-two inches, however, an alternative stroke length may be utilized if desired. The ball drive actuator 18 is designed to provide high stroke speeds under relatively low loading as compared with the first ball actuator 14 described previously. The unit provides for direct coupling of the ball screw 90 to a motor (not shown) encased within housing 86. The basic construction of the ball actuator 90 incorporates a high efficiency 0.653 inch diameter epicyclic ball screw with integral freewheeling at stroke ends to eliminate the need for limit switches.

The actuator 18 transmits thrust with the epicyclic ball screw 90. Stop pins are provided (not shown) at each end of travel to initiate freewheel and linear advancement stops at those points. The epicyclic ball screw 90 thus moves along a reciprocal linear path to push and pull against the telescopic mast section 20 as will be explained below.

A standard 1:1 gear ratio is preferred in the ball drive actuator. The motor of actuator 18 is electrically powered in the preferred embodiment. For vehicle usage, the motor can be 12VDC; however for other applications an AC configuration may be preferable at the option of the user.

The cover 88 is fabricated from aluminum with a ring seal at its outboard end in order to protect the screw 90. The rod end 92 is self-aligning and a weatherproof motor enclosure is provided to protect the motor from the elements.

The housing 87 is provided with external diametrically opposite lugs 85 used in mounting the motor 18 within the base mast section 16 as explained below.

Enclosing a top of the extendible mast section 20 is a server plate 98 having a central through aperture 100. The plate 98 further has a pair of spaced apart sockets 104 in each of two opposite sides, providing attachments in affixing the plate to the mast section 20 by four screws 102. The cover 98 fits over the top of the mast section 20 and provides a mounting surface for the lamp assembly 22.

Mounted to the support plate 98 is a pivoting lamp fixture 22 and a pair of diametrically opposite lamps 24, 26. The assembly comprising fixture 22, 24, 26 is commercially available. For example Havis Shields Corporation, located 395 Jacksonville Road, Warminster, Pa. 18974, manufactures and sells such devices as Model KR-31-37 light-heads. The Havis Shields units are available in both DC or AC versions. The assembly fixture pivots 360 degrees. The lamps 24, 26 are rotatably connected to fixture 22 and can rotate ninety degrees upward and forty degrees downward from the horizontal. The lamp assembly is powered by an electric motor housed within fixture 22. While the assembly shown in the preferred embodiment is a lighting device, the subject invention is not intended to be so limited. Other applications will be apparent for the use of the telescoping mast assembly comprising the invention. By way of example, photographic, communication, or testing devices can be mounted to the upper end of the extendible mast 20 if so desired.

As best shown in FIGS. 1 and 2, a wiring harness 106 comprising a bundle of conductors 108 supplies electrical power and control signals to the motors 14, 18, and to the lamp assembly 22. The ball drive actuator 18 is mounted within a central passageway 110 of the base mast section 16 as lug projections 96 project through the apertures 82 and are fixedly retained by screws 84. The extendible mast section 20 is telescopically received within the passageway 110 and an axial passageway 116 of section 20 is in coaxial alignment with the passageway 110. The ball screw 90 projects upward into passageway 116 and is secured to extendible mast section 20 by a pin member 114 positioned through the ball screw eyelet 92 and an upper end portion of the mast section 20. The stroke of ball screw 90 is selected such that the extendible mast section 20 will not escape the base mast section with the screw 90 in its full out position.

The first drive motor 14 is mounted fixedly to the base plate 12 as described above. So positioned, the ball screw 40 projects forward and is attached between the arms 63 of the base section support 58 by means of pin 65. The motor 14 acts in reciprocal fashion to push the base mast section into a "down", horizontal position when ball screw 40 is fully extended, and pull the base mast section 16 into an "up", vertical, position when ball screw 40 is fully retracted. The ball screw 40 is positioned relative to the base mast section 16 so as to place the section 16 in the "up" and "down" positions at the opposite limits of the ball screw stroke. FIG. 3 illustrates movement of the base mast assembly between the "up" and "down" positions.

The operation of the ball drive actuator 14 is such that the base mast section 16 can be pushed or pulled to any position between the "up" and "down" positions and held in place. This affords the user maximum flexibility in avoiding obstructions and placing the lamp assembly in its optimal location. The base mast section 16 pivots with the support 58 and its position is positively controlled by the operator through electrical control of ball drive actuator 14. Once positioned, the base mast section 16 remains in place until further movement is initiated by the ball drive actuator under control of the user.

Similarly, the operation of ball drive actuator 18 is such that the extendible mast section 20 can be pushed or pulled to any position between the fully extended, "out", position and the fully retracted, "in", position. This gives the user further control over positionment of the lamp assembly and allows the placement of the lamp assembly in an optimum location. Operation of motor 18 is independent of operation of motor 14 and electrical control signals can selectively transmitted to either or both motors 14, 18 to precisely place the mast section 20 or the base mast section 16 in its optimal position. Other pneumatic or hydraulic systems, which only function with the mast sections in either a fully retracted or fully extended position, limit the range of adjustment and substantially reduce the utility of the unit.

The positive operation of the motors 14, 18 upon respective mast sections 16, 20 supplies direct power to push or pull such masts in both extension and retraction directions. The motors thus can overcome radial ice build up between the telescoping mast sections in both the extension and retraction directions. Should ice build up while the mast sections are extended, the motors 14, 18 can overcome the resistance created thereby. In contrast, pneumatic systems use pneumatic power to extend the mast sections but rely upon gravity for retraction of the mast sections. Radial ice build up or ice at the mast junctions, or other contamination between the mast sections, may present such resistance that gravity will fail to bring the mast sections down.

A further advantage of the direct drive provided by the drive motor 18 is that actuation is along the axis of the extendible mast section. Mechanical advantage is thereby maximized. Moreover, the unit of the subject invention can effectively operate on slopes of twenty degrees or more because flexure at the junction of the mast sections will not impair the operation of motor 18. In contrast, pneumatic units of the prior art which rely upon the maintenance of an air tight seal between mast sections will not work consistently over a fifteen degree slope. A greater slope will cause the tubes or mast sections of pneumatic systems to bend, causing air leaks to occur at the mast section junction and a corresponding failure in the drive system.

It will further be appreciated that the subject telescoping mast assembly is sealed from the elements and, accordingly, will function more dependably than alternative prior art systems. The ball drive actuators are sealed against intrusion of water or contaminants. Secondly, the axial passageways in which the actuators reside are enclosed. The cover plate 98 at the top prevents intrusion of the elements from above. Moreover, the base section support 58, base mast section 16, and extendible mast section 20 are enclosed in the assembled condition, preventing the majority of the elements from reaching the ball drive actuators. Prior art devices, for example hydraulic units, have operative components exposed to the elements and can fail from such exposure.

The subject assembly as described above comprises a relatively small number of component parts which are readily assembled and which can, if necessary, be readily repaired. The ball drive actuators 14, 18 can be easily disconnected from their respective mast sections and removed. Replacement of the actuators is equally convenient and can be accomplished with minimal down time. In contrast, hydraulic, pneumatic, or hybrid systems are complicated, comprise a relatively large number of parts, and are relatively more difficult to assemble and repair. In addition, as explained previously, such alternative systems have components mounted in an exposed manner and such components are frequently damaged from rough handling or dirt contamination. The subject invention protects the drive motors within the shaft sections and avoids contact with external obstructions.

From FIGS. 1 and 2 it will be noted that the wiring cable 106 enters into the passageway 110 of the base mast section 16 via aperture 61 and thence proceeds upward through the wiring harness for the subject telescoping mast assembly is housed within the mast sections from the base of the assembly to any device mounted to the top. The wiring is accordingly protected and will not snag or contact obstructions which are inevitably present in field applications. In contrast, prior art mast assemblies have external wiring which can snag on maintenance tools, or low branches or overhead obstructions. Damage to the wiring may remain undetected until the unit is needed in an emergency situation, creating a hazard to those relying upon the unit to function as intended.

Referring to FIG. 1, it will be appreciated that the uppermost mast section 20 can be formed of steel plating if desired. However, according to the teachings of the invention, it is desirable to form the uppermost section 20 from a non-conductive material such as plastic or fiber glass. In so doing, the transfer of an electrical charge from the device at the top of the mast or from the uppermost mast section down to the vehicle that the unit is mounted upon will be prevented. This is critical in an emergency situation where lights, cameras, or other devices mounted on top of the pop-up telescoping mast system can inadvertently be placed into unguarded electrical wires. Furthermore, since the wiring harness 106 is encased within and protected by the mast sections, a fuse system 116 can be incorporated into the wiring circuit within the protected mast passageways and ameliorate concern that the fuse may prove inoperative due to exposure to the elements over time. A fuse 116, of the type common in the industry, in the protected environment of the enclosed mast sections of the present invention will be free of failure from exposure to the elements and will function as expected to stop a surge of electric current from the wires going into the base of the unit, and therefrom into the vehicle frame. A suitable fuse system is manufactured by McMaster-Carr Supply Co. located at 200 Aurora Industrial Parkway, Aurora, Ohio 44202, as parts numbers 7085K78 and 7696K31.

In addition to the advantages summarized above, the subject invention provides a lightweight alternative to conventional telescoping mast systems. The component configuration of the telescoping mast system of the invention, namely the two mast sections, mounting plate, and dual ball drive actuators, is significantly lighter than hydraulic or pneumatic alternatives. This weight reduction not only makes the subject unit easier and more convenient to install, but also reduces the stress imposed upon the vehicle roof to which the unit is attached.

Figure 8:
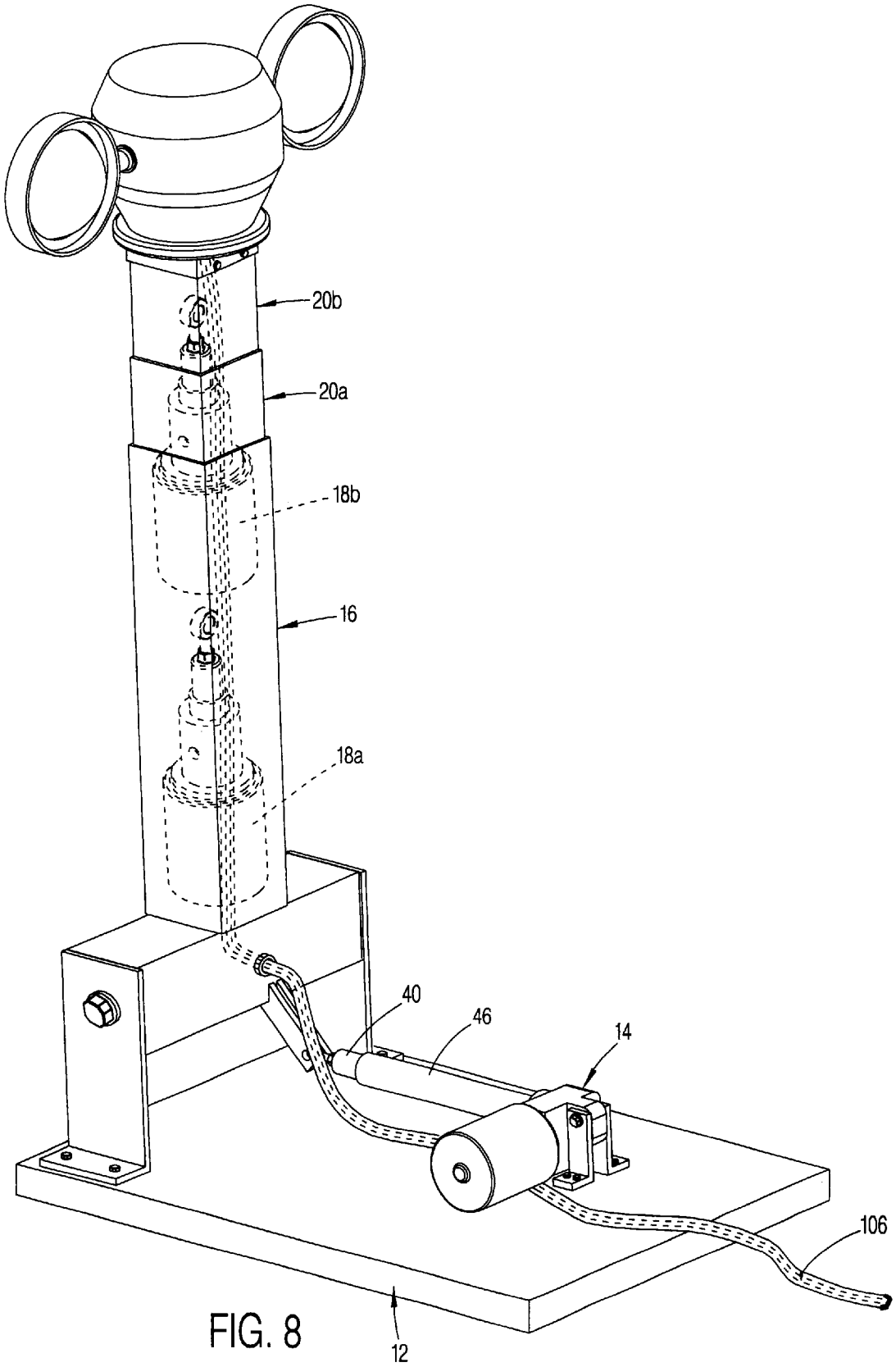
FIG. 8 is a perspective view, shown partially in phantom, of an alternative three stage telescoping mast configured according to the present invention.

An alternative three section telescoping mast assembly is depicted in FIG. 8. Shown in phantom are two ball actuator drives 18-*a*, 18-*b* used to extend and retract respective extendible mast sections 20-*a*, 20-*b*. The addition of a mast section 20-*b* allows for extended reach while still affording the same reliability and adjustability advantages of the two mast section described previously. It will be appreciated that, as with the preferred embodiment, the three section alternative embodiment employs a ball drive actuator for each of the mast sections. A high load actuator 14 is mounted on the base plate 12 as described previously and pivots the base mast section 16 and extendible mast sections 20-*a* and 20-*b* between a horizontal "down" position and a vertical "up" position. The motors and the wiring harnesses are encased within the mast sections and are protected from the elements and from contact with obstructions.

While the above describes a preferred and an alternative embodiment of the subject invention, the invention is not intended to be so restricted. Other embodiments, which will be apparent to those skilled in the art and which utilize the teachings herein set forth, are intended to be within the scope and spirit of the invention.

What is claimed is:

1. An extendible mast assembly comprising:

a base member;

a base mast section pivotally coupled to the base member and pivoting along a path between a down position and an up position;

a drive motor assembly mounted to the base ember and coupled to alternatively push and pull said base mast section to pivotally drive the base mast section between said up and down positions;

an extendible mast section telescopically received within an axial bore of the base mast section and moving therewith between the up and down positions, the extendible mast section telescoping relative to the base mast section between a retracted position and an extended position and having an axial bore coaxial with the base mast section; and wherein a space is defined between the extendible mast section and the base mast section and the assembly further comprises a cover for enclosing an upper end of the space, whereby isolating the coaxial bores of the extendible mast section and the base mast section from ambient elements.

2. An extendible mast assembly comprising:

a base member;

a base mast section pivotally coupled to the base member and pivoting along a path between a down position and an up position;

a drive motor assembly mounted to the base member and coupled to alternatively push and pull said base mast section to pivotally drive the base mast section between said up and down positions;

an extendible mast section telescopically received within an axial bore of the base mast section and moving therewith between the up and down positions, the extendible mast section telescoping relative to the base mast section between a retracted position and an extended position;

an extendible mast section drive motor mounted within the axial bore of the base mast section and coupled to push the extendible mast section into the extended position and pull the extendible mast section into the retracted position; and wherein the extendible mast section drive motor comprises a ball drive actuator.

3. A mast assembly according to claim 2, wherein said ball drive actuator comprises a drive motor, a drive shaft, and a ball drive screw assembly coupled at an inboard end to said drive shaft and at an outboard end to said extendible mast section.

4. A mast assembly according to claim 3, wherein said inboard end comprises an epicyclic ball gear.

5. An extendible mast assembly comprising:

a base member;

a base mast section pivotally coupled to the base member and pivoting along a path between a down position and an up position;

a first motor assembly mounted to the base member and coupled to alternatively move said base mast section between said up and down positions;

at least one extendible mast section telescopically received within an axial bore of said base mast section and moving therewith between said up and said down position, said extendible mast section having an axial bore in coaxial alignment with said base mast section axial bore; and a second motor assembly mounted within said axial bore of said base mast section and coupled to extend said extendible mast section between an extended position and a retracted position.

6. A mast assembly according to claim 5, wherein said base mast section moves between said up and down positions independent of movement of said extendible mast section movement between said extended and retracted positions.

7. A mast assembly according to claim 5, wherein said extendible mast section is composed of electrically non-conductive material.

8. A mast assembly according to claim 5, wherein a space is defined between said extendible mast section and said base mast section and said assembly further comprises a cover for enclosing an upper end of said space, whereby preventing entry of ambient elements into said coaxial bores of said extendible mast section and said base mast section.

9. A mast assembly according to claim 5, wherein said first motor assembly is coupled to alternatively push and pull a lower end of said base mast section to fixedly position said base mast section at alternative positions between said up and said down positions.

10. A mast assembly according to claim 9, wherein said first motor assembly comprises is a ball actuator.

11. A mast assembly according to claim 8, wherein said second motor assembly is coupled to alternatively push and pull said extendible mast section to fixedly position said extendible mast section at alternative positions between said extended and said retracted positions.

12. A mast assembly according to claim 11, wherein said second motor assembly comprises a ball actuator.

13. A mast assembly according to claim 5, wherein said first and said second motor assemblies comprising, respectively, first and second ball actuators.

14. A mast assembly according to claim 5, wherein said first and said second motor assemblies comprise electrically powered motors, said mast assembly further comprising cable means extending within said coaxially aligned base mast section and extendible mast section from a lower end of said base mast to an upper end of said extendible mast.

15. A mast assembly according to claim 14, wherein said cable means is encased by said base mast section and said extendible mast section from said lower end to said upper end.

16. A mast assembly according to claim 15, wherein said first and second motor assemblies are sealed from ambient element contamination.

17. A mast assembly according to claim 15, wherein said extendible mast section is composed of electrically non-conductive material.

18. An extendible mast assembly comprising:

a base member;

a mast section pivotally coupled to the base member and pivoting along a path between a down position and an up position, the mast section having a central axial passageway and an access opening at a lower end communicating with said axial passageway;

a drive motor assembly mounted to the base member and coupled to pivotally drive the mast section between said up and down positions;

an electrical cable extending through the mast section access opening and along the axial passageway to create and electrical circuit to a top end of the mast section; and an electrical device positioned along the electrical cable within the mast section passageway for breaking the electrical circuit between the top end of the mast section and the lower end of the mast section in the event of a current overload.

19. An extendible mast assembly according to claim 18, wherein the electrical device is enclosed with the mast section.

20. An extendible mast assembly according to claim 19, further comprising a cover connecting to the top end of the mast section and enclosing an upper end of the axial passageway.

21. An extendible mast assembly according to claim 20, wherein the cover has a passageway therethrough through which the electrical cable exits the upper end of the axial passageway.

22. An extendible mast assembly according to claim 19, wherein the electrical device comprises a fuse.

* * * * *

UNITED STATES PATENT AND TRADEMARK OFFICE

CERTIFICATE OF CORRECTION

PATENT NO. : 6,546,677 B1
DATED : April 15, 2003
INVENTOR(S) : Harry E. Featherstone It is certified that error appears in the above-identified patent and that said Letters Patent is hereby corrected as shown below:

Column 9,
Line 24, "ember" should be corrected to read -- member --.

Column 11,
Line 14, "and" should be corrected to read -- an --.

Signed and Sealed this

Fifth Day of August, 2003

JAMES E. ROGAN
*Director of the United States Patent and Trademark Office*